United States Patent [19]

Crisafulli

[11] Patent Number: 4,746,553

[45] Date of Patent: May 24, 1988

[54] LIQUID INJECTION MACHINE

[76] Inventor: Joseph T. Crisafulli, P.O. Box 865, Glendive, Mont. 59330

[21] Appl. No.: 82,520

[22] Filed: Aug. 7, 1987

[51] Int. Cl.[4] ..... B05D 1/02; B05D 7/06

[52] U.S. Cl. ..... 427/397; 427/421; 118/305; 118/410

[58] Field of Search ..... 427/421, 397; 118/305, 118/410

[56] References Cited

U.S. PATENT DOCUMENTS

| | | | |
|---|---|---|---|
| 1,597,346 | 8/1926 | Frantz et al. | 118/305 X |
| 2,424,202 | 7/1947 | Woolery | 118/305 |
| 4,381,727 | 5/1983 | Yamaguchi et al. | 118/410 X |
| 4,635,827 | 1/1987 | Roedig | 118/410 X |
| 4,661,368 | 4/1987 | Rohde et al. | 118/410 X |

*Primary Examiner*—Shrive P. Beck

*Attorney, Agent, or Firm*—Fleit, Jacobson, Cohn & Price

[57] ABSTRACT

A liquid injection machine for injecting wood preservative liquid onto railroad ties by injecting liquid through the unused spike hole or holes in a tie plate used to secure a railroad tie to a cross tie. The machine is supported movably on the railroad rails and includes an injection apparatus that can be manually controlled by an operator which allows the operator to inject a liquid through the unused spike holes in a railroad rail tie plate so that the liquid wood preservative will be injected into contact with the surface of the railroad tie beneath the tie plate. The injection apparatus is manually controlled for alignment of an injection nozzle with the unused spike hole and for vertical movement into sealing contact with the unused spike hole so that the wood preservative liquid can be injected under substantial pressure.

9 Claims, 3 Drawing Sheets

LIQUID INJECTION MACHINE

BACKGROUND OF THE INVENTION

1. Field of the Invention

The present invention generally relates to a liquid injection machine and more specifically to such a machine for injecting wood preservative liquid onto railroad cross ties by injecting liquid through the unused spike hole or holes in a tie plate used to secure a railroad rail to a cross tie. The machine is supported movably on the railroad rails and includes an injection apparatus that can be manually controlled by an operator which allows the operator to inject a liquid through the unused spike holes in a railroad rail tie plate so that the liquid wood preservative will be injected into contact with the surface of the railroad tie beneath the tie plate. The injection apparatus is manually controlled for alignment of an injection nozzle with the unused spike hole and for vertical movement into sealing contact with the unused spike hole so that the wood preservative liquid can be injected under substantial pressure.

INFORMATION DISCLOSURE STATEMENT

Efforts have been made heretofore to apply wood preservative to railroad cross ties in situ. However, previously known efforts have not involved the use of an "on railroad track machine" in which operators control manually maneuverable injection devices for injecting wood preservative through the unused spike holes of a railroad cross tie plate.

SUMMARY OF THE INVENTION

An object of the present invention is to provide a liquid injection machine for injecting wood preservative liquid through railroad tie plates for applying the liquid preservative to the surface of the railroad cross tie underlying the tie plate thereby prolonging the useful life of railroad cross ties.

Another object of the invention is to provide a liquid injection machine in accordance with the preceding object which includes a two-wheel or four-wheel vehicle movably supported on a railroad track and connected to an additional cart or carts in a series with control arrangements for propulsion of the modular system along the track in either direction and to provide the capability of pressurizing wood preservative for discharge from applicator nozzles each of which is controlled by an operator oriented in a sitting position on the machine so that an operator can easily observe the tie plates for aligning and engaging the injection nozzles with the unused spike holes for discharge of pressurized wood preservative through the spike holes into contact with the underlying wood surface of the cross ties.

A further object of the invention is to provide a liquid injection machine constructed as a component of a modular system including a power unit and a liquid injection machine so that the modules constituting the system can be easily removed from the railroad tracks when necessary and easily replaced with reduced physical effort thereby enabling more cross ties to be treated during a particular time period even though the operation may be interrupted by train traffic as compared to conventional procedures where "on track" equipment would have to traverse great distances to allow it to move onto a siding track to allow train traffic to pass and then again traverse the same distance to return to the last point of operation before continuing.

Yet another object of the invention is to provide a liquid injection machine in which the operators of the equipment ride on the machine thereby eliminating miles of walking per day and eliminating physical effort required in pushing or pulling carts, hoses and the like thereby reducing fatigue and enabling more ties to be treated with less effort.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
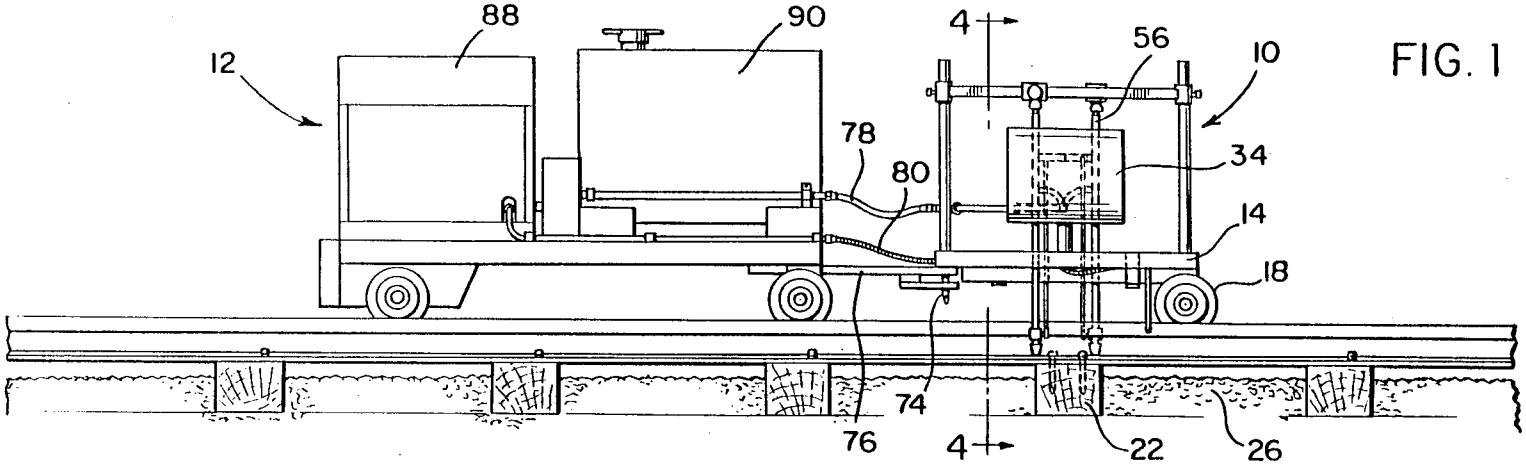
FIG. 1 is an elevational view of the liquid injection machine of the present invention illustrating its association with a power module and railroad track structure.

Referring now specifically to the drawings, the liquid injection machine of the present invention is generally designated by the numeral 10 and, as illustrated in FIG. 1, is in the form of a two-wheeled cart connected to a power unit 12 with it being pointed out that additional units may be connected in tandem series with the modular construction enabling assembly of various required carts. As illustrated, the machine 10 is provided with a frame 14 including an axle 16 supported by flanged wheels 18 that engage rails 20 supported by cross ties 22 on a roadbed 24 which includes the usual ballast 26 with the rails 20 being secured to the cross ties 22 by conventional tie plates 28 secured to the ties by spikes 30 extending through spike holes 32 in the tie plate all of which represent conventional railroad track structure. Normally, the tie plates 28 have spike holes 32 that do not receive rail anchoring spikes 30. The liquid injection machine 10 of the present invention includes a structure to be described in detail hereinafter which injects liquid wood preservative through the unused spike holes 32 in the tie plates 28 for applying the wood preservative to the upper surface of the cross ties 22 which underlies the tie plates and rails thereby prolonging the life expectancy of the cross ties by reducing deterioration of the cross ties, particularly the upper surface thereof which underlies the tie plates 28.

Figure 2:
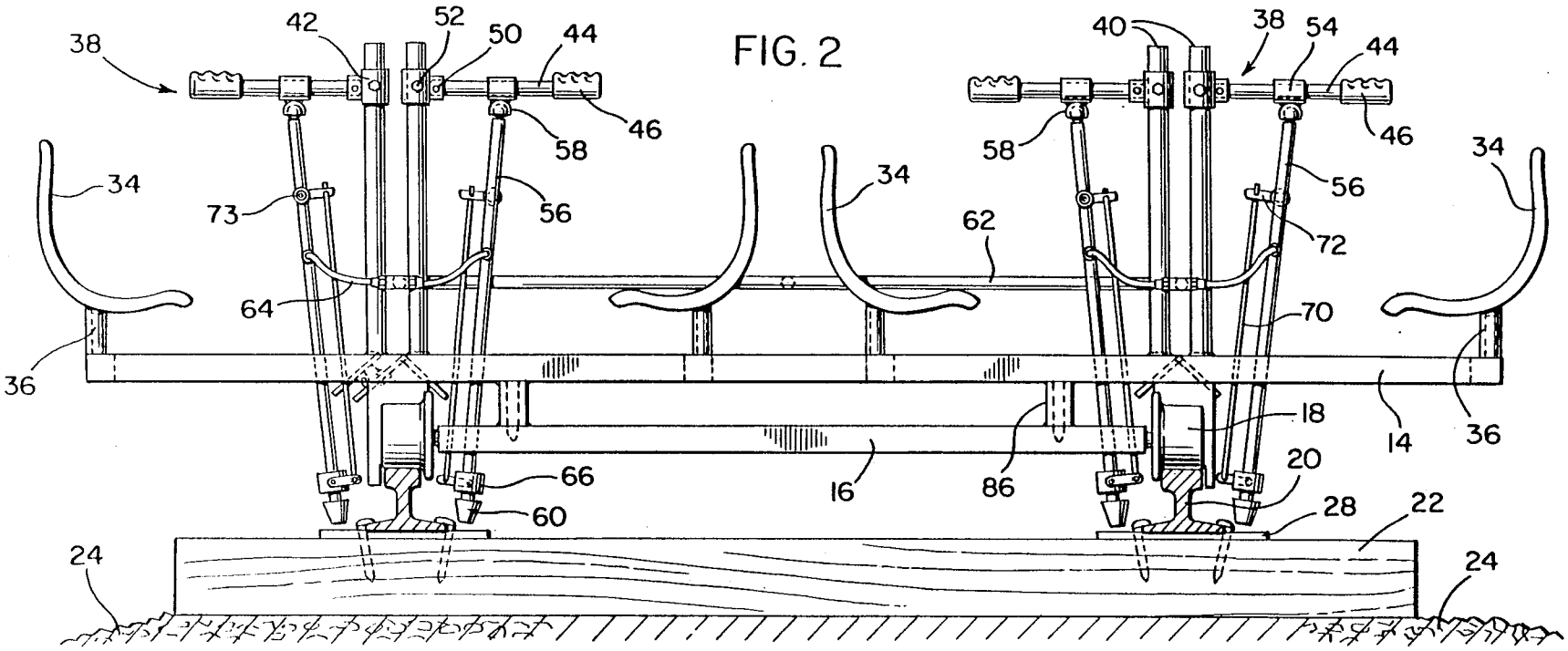
FIG. 2 is a rear elevational view of the invention.
Figure 3:
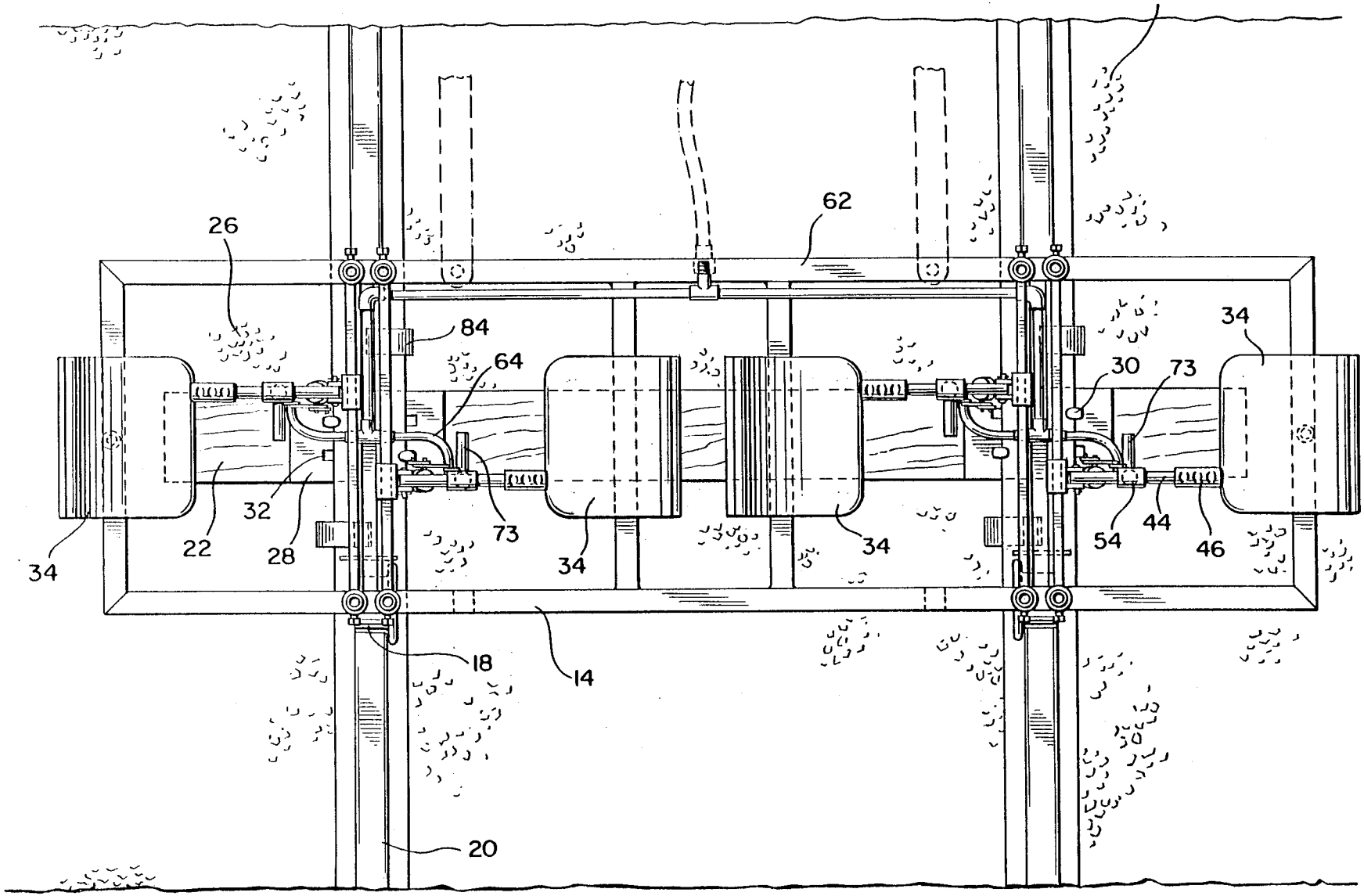
FIG. 3 is a top plan view of the present invention.
Figure 4:
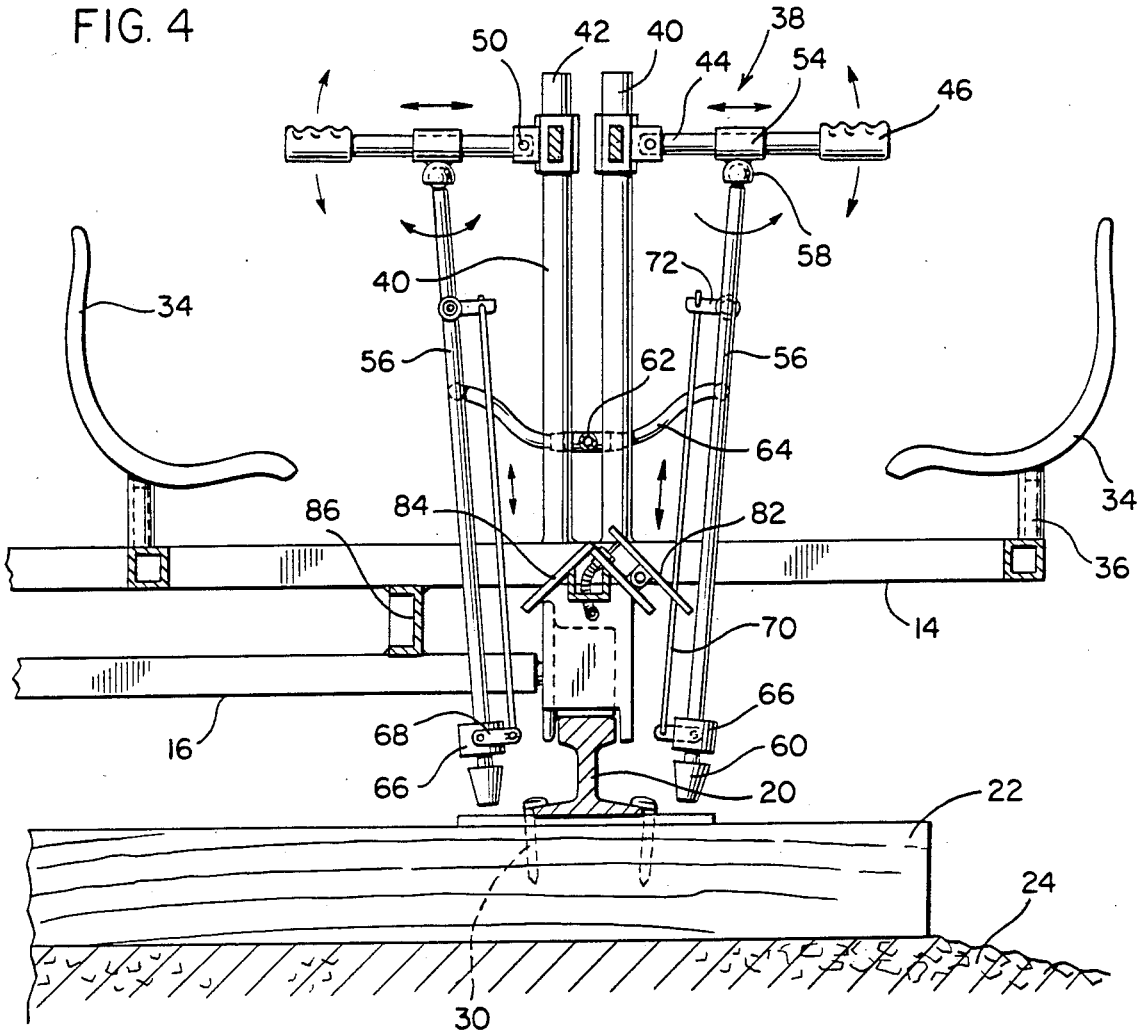
FIG. 4 is a transverse, sectional view, on an enlarged scale taken along section line 4—4 on FIG. 1, illustrating the relationship of the components of the present invention to the railroad rail, cross tie and tie plate.

Mounted on the frame 14 is a plurality of generally transversely aligned seat structures 34 each of which is supported by a pedestal structure 36. As illustrated in FIGS. 2–4, the seats are arranged in facing relation to each other and on opposite sides of each rail 20 so that an operator sitting in the seat 34 can operate the injection apparatus generally designated by numeral 38. The seat structures may be of various conventional materials including plastic, metal or the like and may be vertically adjustably mounted, laterally adjustably mounted and may be of swivel construction if desired to comfortably support an operator for each injection apparatus 38 so that each operator can easily inject wood preservative through tie plates only their side of the rail 20. Thus, a four-seat unit, as illustrated, will be operated by four operators with the machine being stopped at each cross tie until each operator has completed an injection operation for that tie at which time the machine is moved to a position in alignment with the next adjacent cross tie 22. As an alternative to the four-man unit as illustrated, a two-man unit may be utilized in which the operator's seat is positioned directly over the rail and the operator must then align the injection apparatus 38 with the unused spike holes in the tie plate on both sides of the associated rail. In either event, the operator controls the positioning and operation of the injection apparatus 38 and one of the operators controls the forward or reverse movement of the machine 10 and power unit 18 on the rails so that successive cross ties may be treated with the injection apparatus being moved sequentially from one cross tie to an adjacent cross tie.

The injection apparatus 38 includes a vertically extending support member 40 rigid with the frame 14 with a sleeve 42 being mounted on the upright support 40 and having a handle 44 pivotally connected thereto with the handle 44 including a handgrip 46 at its outer end. The handgrip 46 extends toward the operator's seat 34 and is located higher than the operator's seat 34 in a convenient location so that an operator may comfortably grasp the handgrip 46 and move it vertically about a pivot pin or bolt 50 that connects the inner end of the handle 44 to the sleeve 42 which can be secured in adjusted position by a set screw 52 or a pair of spaced collars may be secured to the support member 40 above and below the sleeve 42 so that the sleeve 42 can pivot or swing about the support member 40 if desired. Also, a tension coil spring may interconnect the upper end of the support 40 and the outer end portion of the handle 44 to bias the handgrip 46 upwardly to a retracted position.

Figure 5:
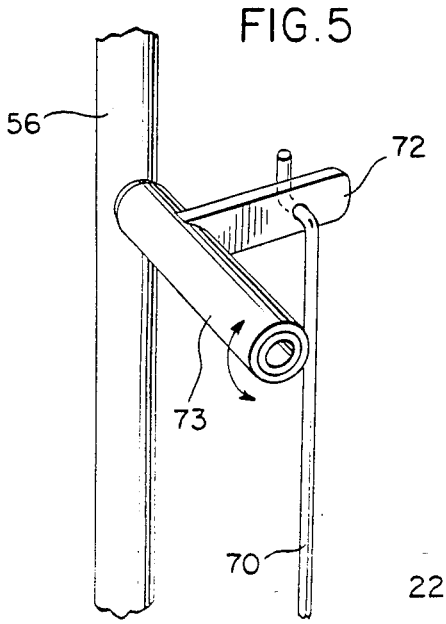
FIG. 5 is a fragmental perspective view of a handle on a nozzle actuating rod.
Figure 6:
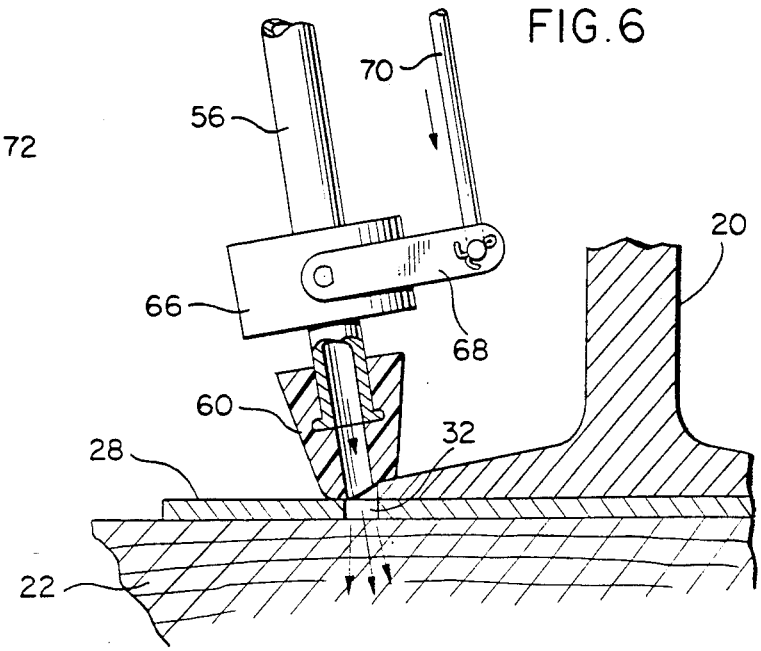
FIG. 6 is a fragmental detailed sectional view illustrating further details of the nozzle and tie plate.

Mounted on the handle 44 is a sleeve 54 which can slide inwardly and outwardly in relation to the handle 44 with the sleeve 54 being connected to the upper end of a tubular member 56 by a ball and socket or similar universal connection 58. The lower end of the tubular member 56 is provided with a tapered discharge nozzle 60 that fits into and sealingly engages the tie plate hole 32 with the exterior of the nozzle 60 being constructed of rubber, neopreme or other material that enables it to conform with the periphery of the hole 32 and sealingly engage the hole 32 to discharge wood preservative through the hole 32 under a pressure determined by the pressure in a supply pipe 62 supported from the frame 14 in any suitable manner and connected to the tubular member 56 by a hose 64 or the like. The tubular member 56 includes a valve 66 adjacent the nozzle 60 with the valve 66 including an operating lever 68 connected to an actuating rod 70 extending upwardly alongside the tubular member 56 and connected to a pivoted lever type of actuator 72 mounted on a handle 73 on tubular member 56 as shown in FIG. 5 whereby the actuating rod 70 may be manually operated by the operator from the seat 34 to open the valve 66 for discharging pressurized wood preservative through the tie plate hole 32. Thus, with this construction, the operator may adjust the position of the nozzle 60 so that it is accurately aligned with the tie plate hole 32 and then by exerting downward pressure on the handgrip 46, the tapered nozzle 60 will be brought into sealing engagement with the hole 32 as shown in FIG. 6 after which the valve 66 is manually opened and wood preservative under pressure is discharged through the nozzle 60 from the supply pipe 62 and supply hose 64. The frame 14 is provided with a depending connecting pin or pins 74 for connection with a draw bar or other connection 76 with the unit 12 with a pressure hose 78 and control cable 80 also interconnecting the liquid injection machine 10 and the unit 12 so that one of the operators has a foot control 82 available to control forward and reverse movement of the unit 12 and the injection machine 10 for aligning the nozzles approximately with the tie holes with final positioning being obtained by individual movement of the nozzles. Also, each operator is provided with foot rests 84 which are stationary and do not control the apparatus as does the foot pedal 82.

The axle and wheels are constructed to match the rail size and distance between the rails with the base frame being constructed of relatively lightweight square tubing or the like with each operator having a pair of foot rests and at least one operator having a foot-operated control for controlling operation of the modular unit so that it can be propelled forwardly, be stopped or moved in reverse direction from the operator's chair or seat. Also, the handle 44 may be a length of square tubing and the sliding sleeve 54, ball and socket joint 58 and the injector control handle 72 may be of conventional construction with the chemical hose 64, tubular member 56, injection valve 66 and nozzle 60 all being relatively inexpensive components and functioning to sealingly connect the discharge nozzle 60 to the hole in the tie plate. The support structures 36 for the operator's seat may be vertically adjustable and also, the frame 14 may be supported from the axle 16 by vertical supports 86 which may be adjustable to enable vertical adjustment of the frame 14 and thus the components mounted thereon.

With the injection nozzle being movable in lateral directions as well as vertical directions, the operator can manually center the injector and guide it into the tie plate spike opening and due to the fulcrum arrangement on the handle, the operator can apply substantial downward pressure on the injector nozzle for maintaining the injection pressure from the reservoir of wood preservative to the surface of the tie under the tie plate when appropriate valves are opened or when an electrically operated solenoid valve is utilized in lieu of the manual valve.

The fluid injection machine 10 is a component of a modular system including a series of one or more additional carts such as the power unit 12 having an engine 88 to provide hydraulic fluid at a regulated pressure for propulsion of the entire assembly along the track and to provide power for an air compresser if it is desired to pressurize the liquid preservative in a pressure tank 90 for discharge at the applicator nozzle 60. The engine may drive a hydraulic pump to supply pressurized fluid preservative to the supply pipe 62. Thus, the total system is built in modular form of lightweight units so that two operators are capable of removing the total system from the railroad tracks by removing one module at a time and replacing the same with little or no physical effort thereby enabling the units to be removed from the railroad rails when a train approaches with the units then being placed back on the rails after the train passes thereby eliminating the necessity of the device being moved along the track and onto a siding in order to enable a train to pass through the area of the railroad track being treated with wood preservative. This provides a substantially continuous operation with very little time lost in moving the machine to a siding while a train passes and then moving it back to the work site. Each operator has adequate visibility and one operator is able to control both the forward and reverse movement of the machine to allow for quick and easy placement of the injection nozzles over the tie plates and alignment of the nozzles with the unused spike holes in the tie plate. The injector nozzles can easily be placed in the tie plate holes with each nozzle sealingly engaging the periphery of the hole and liquid preservative discharged by opening a control valve. After one tie plate has been serviced, the machine can be moved to a position in alignment with the next adjacent tie plate.

The liquid injection machine may be constructed with the capability of four operators occupying four seats which are oriented in facing pairs on opposite sides of each rail so that each operator will only be concerned with injecting liquid through the unused spike hole 32 on the same side of the rail as that operator. Alternatively, a two-operator unit may be provided in which the operator is supported from the frame in a seat in overlying, vertically spaced alignment with the rail so that the injection apparatus can be swung laterally from one side of the rail to the other so that the injection apparatus can be associated with the unused spike hole 32 on each side of the rail. As an alternate supporting arrangement, the cart may be constructed with four supporting wheels by providing an additional axle and wheels adjacent the front of the cart. All of the arrangements utilize a relatively lightweight construction to facilitate removal from and replacement onto the rails.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An apparatus for applying wood preservative material onto railroad cross ties which support railroad rails with tie plates interconnecting the rails and ties with the tie plates including spike holes with certain of the spike holes being unused comprising a mobile frame, a nozzle registrable with an unused spike hole, means supporting the nozzle from the mobile frame for movement into alignment with an unused spike hole and for generally vertical movement into engagement with the unused spike hole, and means supplying pressurized wood preservative to the nozzle for discharging wood preservative liquid through the unused spike hole onto the upper surface of the cross tie underlying the tie plate.

2. The structure as defined in claim 1 wherein said mobile frame includes flanged supporting wheels mounted on railroad rails for movement thereon with the frame including a plurality of nozzles mounted on the frame and occupant seat means mounted on the frame to support occupants for manually moving each nozzle into engagement with an unused spike hole and means accessible to an operator from the operator's seat to control discharge of wood preservative from each nozzle.

3. The structure as defined in claim 2 wherein said mobile frame includes an upright support, each nozzle being of tapered configuration for sealing contact with the periphery of the unused spike hole, an actuating rod connected to each nozzle and being supported from the support member for vertical and lateral adjustment, handle means connected with the upper end of the actuating rod and support member to enable downward force to be exerted on the actuating rod and nozzle to lower the nozzle into contact with the unused spike hole in the tie plate.

4. The structure as defined in claim 3 wherein said handle means includes an elongated handle, means connecting the handle to the support member for swingable movement and means connecting the upper end of the support rod and an intermediate portion of the handle to enable downward force to be exerted on the support rod when the handle is pivoted downwardly.

5. The structure as defined in claim 4 wherein the means connecting the handle to the upper end of the support rod is longitudinally adjustable on the handle to vary the distance between the end of the handle attached to the support member and the portion of the handle engaged with the upper end of the actuating rod.

6. The structure as defined in claim 5 wherein said frame includes four occupant seats and four nozzles with the seats and nozzles being arranged on opposite sides of railroad rails for alignment with unused spike holes in portions of the tie plates extending inwardly and outwardly in relation to the rails.

7. The structure as defined in claim 6 wherein said frame includes a hitch structure for connection with a railroad track supported power unit with the power unit and apparatus being readily separable and capable of connection with other modular structures to enable operators to remove the power unit and other modules from the railroad track at any location at the approach of a passing train thereby eliminating the necessity of an "on-track" cart being moved to a railroad track siding and then returned to the work site after a train has passed thereby enabling a larger number of cross ties to be treated with wood preservative in a given length of time.

8. The structure as defined in claim 7 wherein said frame includes a pressurized supply of wood preservative connected with each nozzle through an independent control valve operated by the operators to enable positioning of the nozzles in sealing contact with the periphery of the unused spike holes while exerting downward pressure thereon and releasing a quantity of wood preservative for injection between the tie plate and upper surface of the cross tie under pressure.

9. The method of applying wood preservative to railroad cross ties in situ consisting of the steps of moving an "on-track" nozzle assembly into alignment with a cross tie and tie plate, moving a nozzle component of the nozzle assembly laterally and vertically into contact with an unused spike hole in a tie plate, maintaining downward force on the nozzle and opening a control valve to communicate pressurized wood preservative with the nozzle for discharging wood preservative from the nozzle, down through the unused spike hole and into the area between the under surface of the tie plate and the upper surface of the cross tie while under pressure for prolonging the expectant life of the cross tie by applying wood preservative to an area most subject to deterioration.

* * * * *